US007651200B2

(12) United States Patent
Katayama

(10) Patent No.: US 7,651,200 B2
(45) Date of Patent: Jan. 26, 2010

(54) INK JET HEAD

(75) Inventor: Naoki Katayama, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 490 days.

(21) Appl. No.: 11/425,199

(22) Filed: Jun. 20, 2006

(65) Prior Publication Data

US 2006/0284939 A1 Dec. 21, 2006

(30) Foreign Application Priority Data

Jun. 20, 2005 (JP) ..... 2005-179415

(51) Int. Cl.
*B41J 2/045* (2006.01)

(52) U.S. Cl. ..... 347/68; 347/72

(58) Field of Classification Search ..... 347/68, 347/70–72

See application file for complete search history.

(56) References Cited

U.S. PATENT DOCUMENTS

| | | | |
|---|---|---|---|
| 6,672,715 | B2 | 1/2004 | Isono et al. |
| 2002/0196315 | A1 | 12/2002 | Isono et al. |
| 2003/0156167 | A1 | 8/2003 | Sakaida et al. |
| 2004/0218018 | A1 | 11/2004 | Sakaida et al. |
| 2005/0185028 | A1 | 8/2005 | Sakaida et al. |
| 2006/0125878 | A1 | 6/2006 | Watanabe |

FOREIGN PATENT DOCUMENTS

| | | | |
|---|---|---|---|
| EP | 0925923 | A1 | 6/1999 |
| EP | 1336494 | A1 | 8/2003 |
| EP | 1338421 | A2 | 8/2003 |
| EP | 1372199 | A1 | 12/2003 |
| EP | 1393906 | A1 | 3/2004 |
| JP | S61-079669 | A | 4/1986 |
| JP | 2001-309672 | A | 11/2001 |
| JP | 2003-053982 | A | 2/2003 |

OTHER PUBLICATIONS

State Intellectual Property Office, Notification of First Office Action in Chinese Patent Appl'n No. 200610093814.X (counterpart to the above-captioned U.S. patent application) mailed Feb. 15, 2008.

State Intellectual Property Office, Notification of First Office Action in Chinese Patent Appl'n No. 200610093815.4 (counterpart to the above-captioned U.S. patent application) mailed Feb. 15, 2008.

(Continued)

*Primary Examiner*—An H Do
(74) *Attorney, Agent, or Firm*—Baker Botts L.L.P.

(57) ABSTRACT

An ink jet head is provided with a passage unit, an actuator unit, and a conductive adhesion layer. The passage unit comprises a nozzle and a pressure chamber communicating with the nozzle. The actuator unit comprises a piezoelectric layer, a first electrode connected with a front surface of the piezoelectric layer, a second electrode connected with a back surface of the piezoelectric layer, and a first insulating layer located between the second electrode and the passage unit. The conductive adhesion layer adheres to both a front surface of the passage unit and a back surface of the actuator unit. The conductive adhesion layer is electrically connected with the second electrode.

15 Claims, 8 Drawing Sheets

OTHER PUBLICATIONS

U.S. Appl. No. 11/425,215, filed Jun. 20, 2006.

European Patent Office, European Search Report for Related EP Application No. 06012513 dated Nov. 28, 2006.

Japanese Patent Office, Notification of Reasons for Rejection for Japanese Patent Application No. 2005-179415 (counterpart to above-captioned patent application), mailed Sep. 24, 2008.

European Patent Office, European Search Report for the corresponding European Patent Application No. 05027105.5 (now European Patent No. EP1671796) of the co-pending U.S. Appl. No. 11/302,459, filed Mar. 17, 2006.

European Patent Office, European Office Action for the corresponding European Patent Application No. 05027105.5 (now European Patent No. EP1671796) of the co-pending U.S. Appl. No. 11/302,459, filed Jan. 15, 2007.

European Patent Office, European Search Report for the corresponding European Patent Application No. 06012514.3 (now European Patent No. EP1736315) of the co-pending U.S. Appl. No. 11/425,215, filed Sep. 25, 2006.

United States Patent and Trademark Office, Office Action issued for the co-pending U.S. Appl. No. 11/425,215, filed May 19, 2009.

INK JET HEAD

CROSS-REFERENCE TO RELATED APPLICATION

This application claims priority to Japanese Patent Application No. 2005-179415, filed on Jun. 20, 2005, the contents of which are hereby incorporated by reference into the present application.

BACKGROUND OF THE INVENTION

1. Field of the Invention

The present invention relates to an ink jet head. The ink jet head is utilized in a device that prints words, images, etc. by discharging ink toward a print medium. The ink jet head is utilized in, for example, an ink jet printer, a copier, a fax machine, a multifunctional product, etc.

2. Description of the Related Art

A normal ink jet head comprises a passage unit and an actuator unit. The passage unit comprises a nozzle and a pressure chamber. The nozzle discharges ink toward a print medium. The pressure chamber is filled with ink. The pressure chamber communicates with the nozzle.

The actuator unit may be stacked on the passage unit. The actuator unit may be a type having a piezoelectric element. The piezoelectric element may include a piezoelectric layer, a first electrode connected with a front surface of the piezoelectric layer, a second electrode connected with a back surface of the piezoelectric layer, and an intermediate layer located between the second electrode and the passage unit. The piezoelectric layer contracts in a planar direction when a potential difference is applied between the first electrode and the second electrode. The first electrode, the second electrode, and the intermediate layer are unable to contract in the planar direction. As a result, the force for causing the piezoelectric layer to contract in the planar direction is transformed into a force for deforming the entire piezoelectric element in a direction of thickness. The piezoelectric element is deformed toward the pressure chamber by applying potential difference between the first electrode and the second electrode. When the piezoelectric element deforms towards the pressure chamber, the volume of the pressure chamber decreases. The pressure of the ink within the pressure chamber is increased, and the ink is discharged from the nozzle. When the potential difference between the first electrode and the second electrode is cancelled, the state in which the piezoelectric element is deformed towards the pressure chamber is released. The volume of the pressure chamber consequently increases, and ink is drawn into the pressure chamber from an ink chamber.

When the intermediate layer is present between the second electrode and the passage unit, the entire piezoelectric element deforms by a greater amount in the direction of thickness. An insulating layer is usually utilized in this intermediate layer. By using this configuration, the pressure within the pressure chamber can be increased and decreased efficiently. An ink jet head having the above configuration is taught in, for example, U.S. Pat. No. 6,672,715.

When, for example, a print medium (printing paper for example) is charged, an electric charge may move from the print medium to the passage unit. The passage unit is thus charged, and the potential of the passage unit may become greater than the potential of the second electrode. In this case, components of the ink (such as hydrogen ions) within the passage unit may be attracted toward the actuator unit (the second electrode), and may penetrate into the actuator unit. When, for example, hydrogen ions have penetrated the actuator unit, hydrogen gas may be formed within the actuator. When hydrogen gas is formed within the actuator unit, the layers within the actuator unit (for example the piezoelectric layer and the second electrode) may peel off.

In the conventional technique (U.S. Pat. No. 6,672,715), the second electrode is exposed at a side surface of the actuator unit. A conductive adhesive is applied across a front surface of the passage unit from the exposed part of the second electrode. The second electrode and the passage unit are thus electrically connected, and the second electrode and the passage unit therefore maintain an approximately identical potential. The components of the ink within the passage unit can thus be prevented from penetrating into the actuator unit.

BRIEF SUMMARY OF THE INVENTION

The passage unit vibrates when pressure is increased or decreased within the pressure chamber of the passage unit. With the conventional technique, the actuator unit is not stacked at the part where the conductive adhesive has been applied to the front surface of the passage unit. The conductive adhesive is exposed at the front surface of the passage unit. In this case, the conductive adhesive may separate from the passage unit when the passage unit vibrates, and consequently the connection between the second electrode and the passage unit may be interrupted.

This specification will provide a technique in which the second electrode and the passage unit can be electrically connected in a more stable manner.

An ink jet head taught in the present specification has a passage unit, an actuator unit, and a conductive adhesion layer. The conductive adhesion layer adheres to both a front surface of the passage unit and a back surface of the actuator unit. The conductive adhesion layer is electrically connected with the second electrode.

With this configuration, the conductive adhesion layer is sandwiched between the passage unit and the actuator unit. As a result, it is possible to effectively prevent the phenomenon wherein the conductive adhesion layer separates from the passage unit or the actuator unit. With this ink jet head, the second electrode and the passage unit can be electrically connected in a more stable manner.

BRIEF DESCRIPTION OF THE DRAWINGS

FIG. 7 (*b*) shows a plan view of a part of the actuator unit.

DETAILED DESCRIPTION OF THE INVENTION

Embodiment

Figure 1:
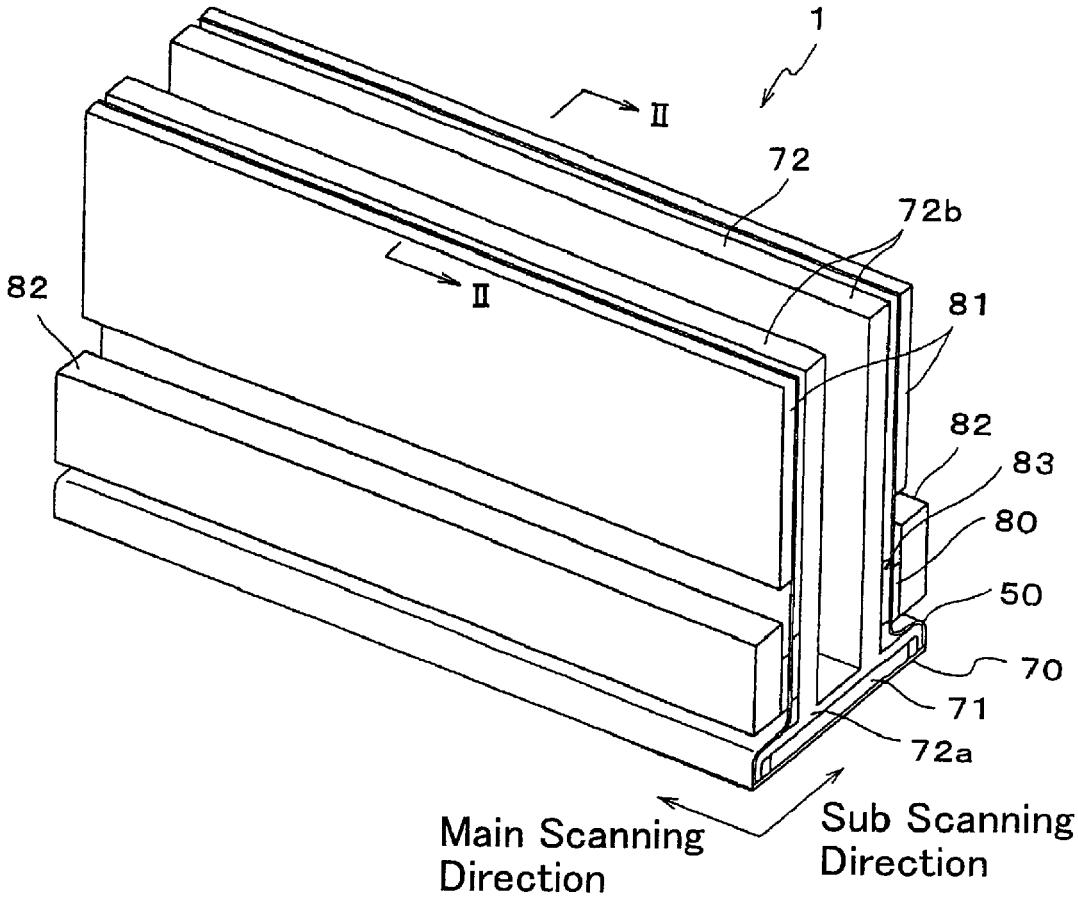
FIG. 1 shows a perspective view of an ink jet head of the present embodiment.

An embodiment of the present invention will now be described with reference to the drawings. FIG. 1 shows a perspective view of an ink jet head 1. The ink jet head 1 is utilized while mounted on an ink jet printer.

The ink jet head 1 comprises a head main body 70, a base block 71, a holder 72, etc. The head main body 70 has a rectangular shape that extends in a main scanning direction. The base block 71 is disposed on an upper surface of the head main body 70. An ink reservoir 3 (to be described: see FIG. 2) is formed in the base block 71. The holder 72 supports the head main body 70 and the base block 71.

Figure 2:
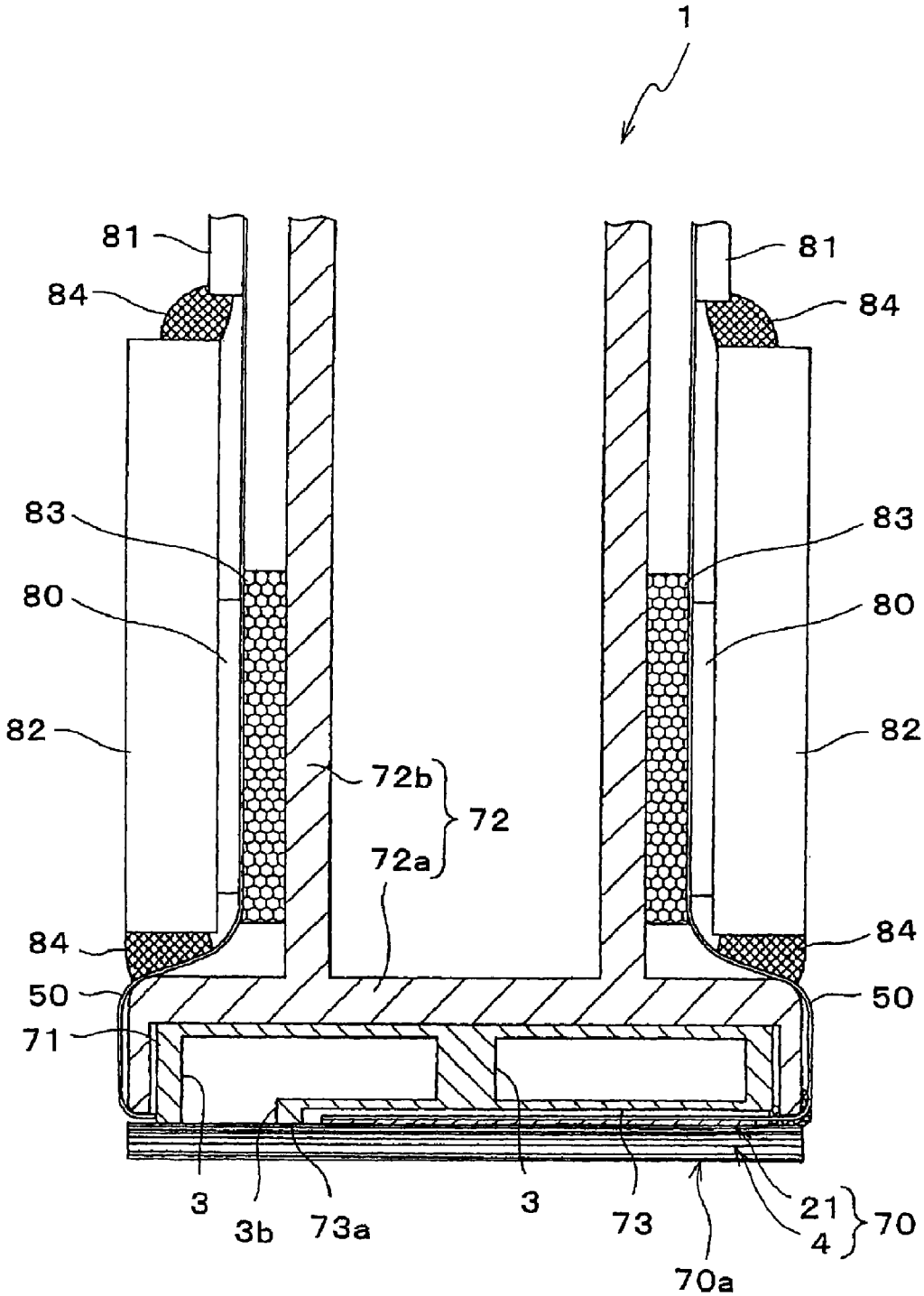
FIG. 2 shows a cross-sectional view along the line II-II of FIG. 1.

FIG. 2 shows a cross-sectional view along the line II-II of FIG. 1. The head main body 70 includes a passage unit 4 and an actuator unit 21 stacked on the passage unit 4. The passage unit 4 has a configuration in which a plurality of thin plates is stacked. An ink passage is formed in the passage unit 4. A plurality of nozzles 8 (see FIG. 6) with an extremely small diameter is disposed in a bottom surface 70*a* of the passage unit 4. Ink is discharged downwards from the bottom surface 70*a* of the passage unit 4.

The actuator unit 21 also has a configuration in which a plurality of thin plates is stacked. The actuator unit 21 is connected with an upper surface of the passage unit 4 by a conductive adhesion layer 6 (to be described: see FIG. 6). In the present embodiment, a plurality of actuator units 21 is connected with the passage unit 4. A flexible printed circuit (FPC) 50 is soldered to an upper surface of the actuator unit 21. The FPC 50 is led to a side (the left or the right in FIG. 2) of the ink jet head 1.

Figure 3:
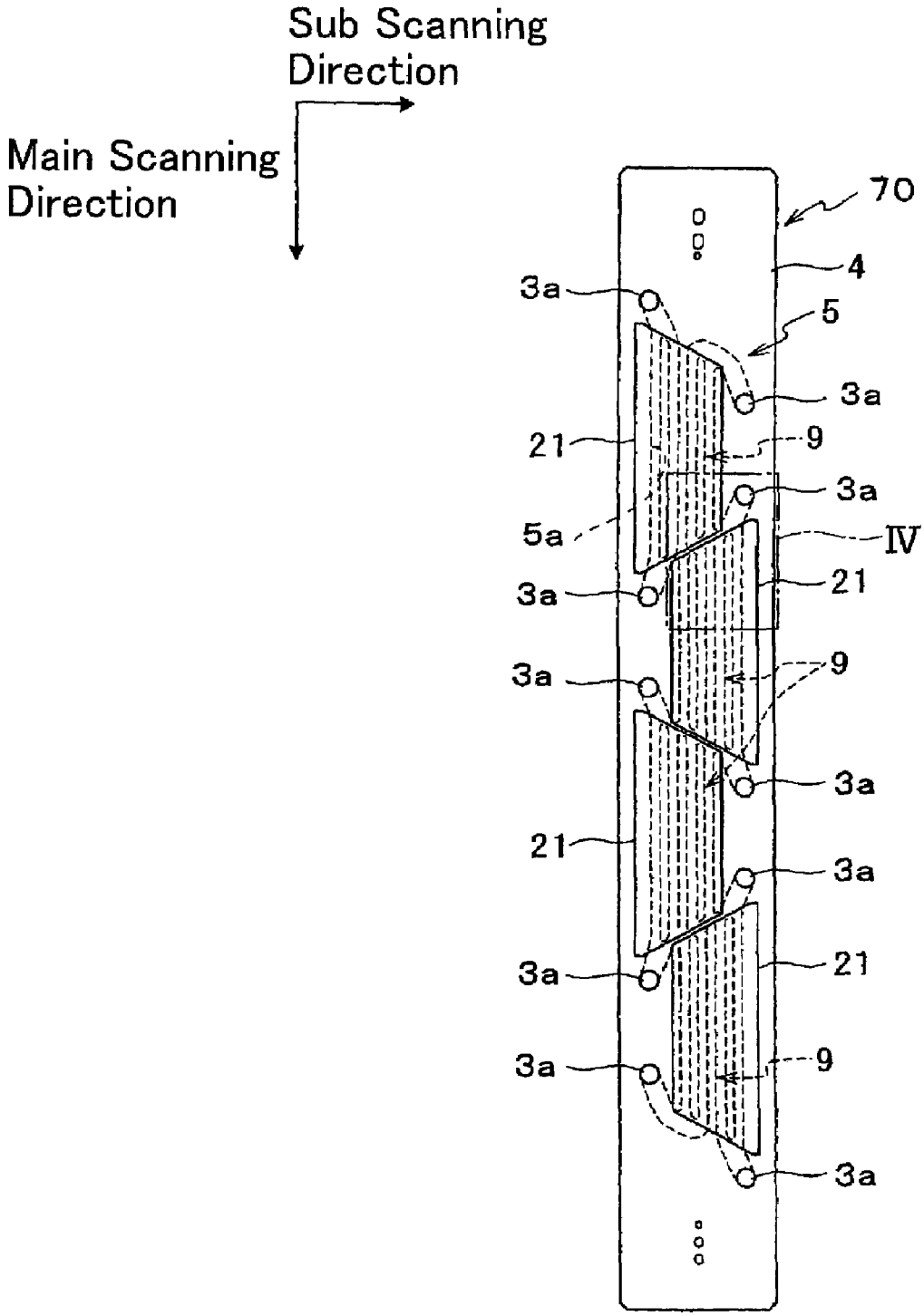
FIG. 3 shows a plan view of a head main body.

FIG. 3 shows a plan view of the head main body 70 (viewed from the opposite side from the bottom surface 70*a*). The passage unit 4 has a rectangular shape that extends in the main scanning direction. A manifold passage 5 is formed within the passage unit 4. The manifold passage 5 is shown by a broken line. The manifold passage 5 functions as a common ink chamber. The manifold passage 5 has a plurality of sub manifold passages 5*a* that extends in a parallel manner in the main scanning direction of the passage unit 4.

Ten openings 3*a* are formed in the upper surface of the passage unit 4 (the surface connected with the actuator unit 21). Five of the openings 3*a* are aligned in the main scanning direction along a right edge of the passage unit 4. The other five of the openings 3*a* are aligned in the main scanning direction along a left edge of the passage unit 4. The ink of the ink reservoir 3 of the base block 71 is led into the manifold passage 5 through the openings 3*a*.

Four actuator units 21 are disposed in a staggered pattern in positions that do not interfere with the openings 3*a* of the passage unit 4. Each of the actuator units 21 has a trapezoid shape when viewed from a plan view. The actuator units 21 are disposed so that a long edge and a short edge thereof extend along the main scanning direction. Two adjacent actuator units 21 overlap in the main scanning direction and the sub scanning direction.

A more detailed description of the configuration of the head main body 70 will be described later.

Returning to FIG. 2, the configuration of the base block 71 will be described. The base block 71 is formed from metal. The base block 71 is formed from, for example, stainless steel. The ink reservoir 3 within the base block 71 extends in the main scanning direction (a direction perpendicular to the page of FIG. 2). An inlet hole (not shown) is formed in one end of the reservoir 3. The inlet hole is connected with an ink tank (not shown: for example an ink cartridge). The ink of the ink tank is led into the ink reservoir 3 via the inlet hole.

The ink reservoir 3 has an outlet hole 3*b*. Although only one outlet hole 3*b* has been shown in FIG. 2, ten outlet holes 3*b* are actually formed. The outlet holes 3*b* are formed in positions corresponding with the openings 3*a* of the passage unit 4. The ink of the ink reservoir 3 is led into the manifold passage 5 via the outlet holes 3*b* and the openings 3*a* of the passage unit 4.

In the base block 71, neighboring portions 73*a* of the outlet holes 3*b* protrude downwards. Only these protruding portions 73*a* make contact with the upper surface of the passage unit 4. That is, there is a space between the upper surface of the passage unit 4 and the portion of the base block 71 other than the protruding portions 73*a*. The actuator unit 21 is disposed in this space.

Next, the configuration of the holder 72 will be described. The holder 72 includes a grip portion 72*a* that grips the base block 71, and a pair of protruding parts 72*b* that protrude upwards from an upper surface of the grip portion 72*a*.

The grip portion 72*a* has a concave part that opens downwards. The base block 71 is fixed within this concave part by means of adhesive.

The pair of protruding parts 72*b* is aligned in the sub scanning direction (the left-right direction of FIG. 2) with a space therebetween. The FPC 50 connected with the actuator unit 21 extends upwards along the protruding parts 72*b*. A resilient member 83 (a sponge, for example) is disposed between one surface of the FPC 50 and the protruding parts 72*b*. A driver IC 80 is connected with the other surface of the FPC 50. The actuator unit 21 and the driver IC 80 are electrically connected via the FPC 50. The FPC 50 transmits driving signals output from the driver IC 80 to the actuator unit 21.

A heat sink 82 that has a substantially rectangular parallelopiped shape makes contact with the driver IC 80. The heat sink 82 allows heat generated by the driver IC 80 to escape. A base 81 is disposed above the heat sink 82, and is fixed to one end of the FPC 50. A sealing member 84 is disposed between the base 81 and an upper end of the heat sink 82. A sealing member 84 is also disposed between a lower end of the heat sink 82 and the FPC 50. These sealing members 84 can prevent refuse or ink from entering within the ink jet head 1.

Figure 4:
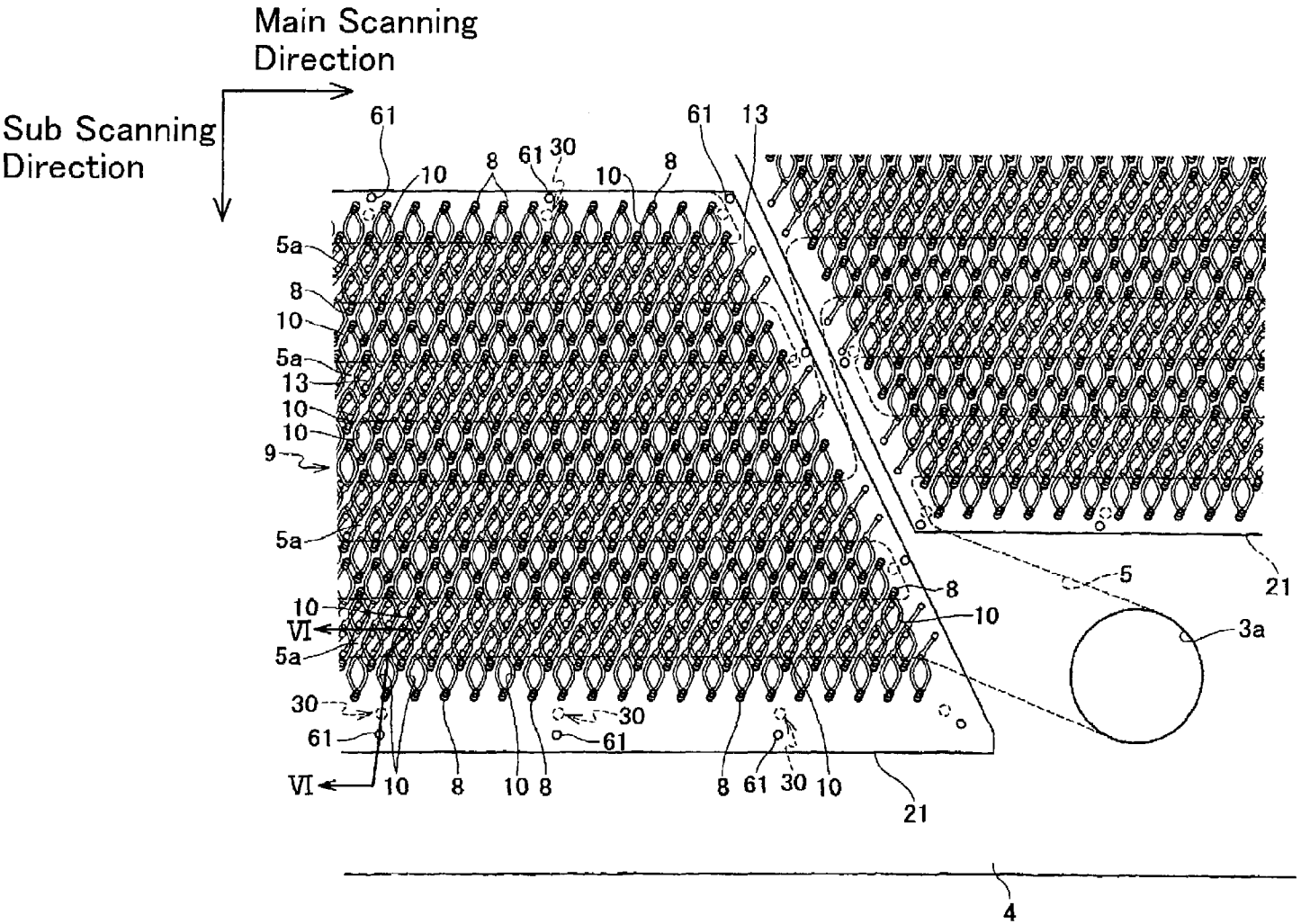
FIG. 4 shows an expanded view of a region IV of FIG. 3.

Next, the configuration of the head main body 70 will be described in detail with reference to FIG. 4. FIG. 4 shows an expanded view of a region IV of FIG. 3. In FIG. 4, nozzles 8, pressure chambers 10, and apertures 13 that cannot actually be seen are shown by solid lines.

As described above, a plurality of sub manifold passages 5*a* is formed in the passage unit 4. Four sub manifold passages 5*a* correspond to one actuator unit 21. The four sub manifold passages 5*a* extend in a parallel manner in the main scanning direction. A plurality of ink passages 7 (see FIG. 6), which communicates with a plurality of nozzles 8, is connected with the sub manifold passages 5*a*.

The passage unit 4 has a plurality of pressure chambers 10 and a plurality of nozzles 8. The pressure chambers 10 are disposed in a matrix shape. From a plan view, each pressure chamber 10 is substantially diamond shaped. One longer diagonal edge of each pressure chamber 10 communicates with one nozzle 8. The other longer diagonal edge of each pressure chamber 10 communicates with one aperture 13. The aperture 13 communicates with the sub manifold passage 5*a*. Below, a plurality of pressure chambers 10 that corresponds to one actuator unit 21 will be termed a pressure chamber group 9. One actuator unit 21 overlaps with all the pressure chambers 10 of the pressure chamber group 9.

The plurality of nozzles 8 opens into the bottom surface 70*a* of the passage unit 4 (see FIG. 2). Like the pressure chamber group 9, the nozzles 8 are disposed in a matrix shape.

Figure 5:
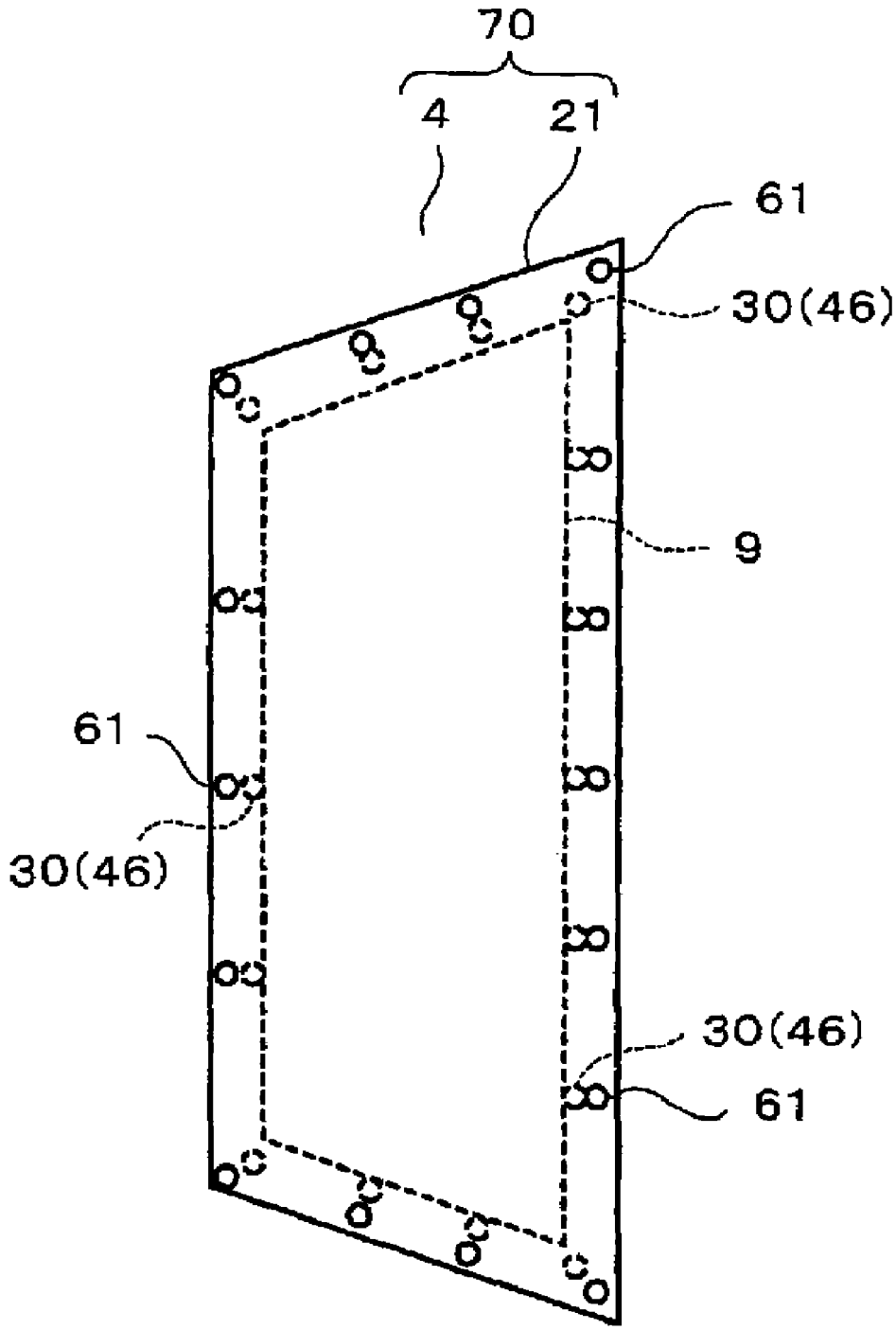
FIG. 5 shows a plan view of one actuator unit.

FIG. 5 shows a plan view of one actuator unit 21. Each of the pressure chambers 10 is not shown in FIG. 5, and the region in which the pressure chamber group 9 is formed is shown by a broken line.

Although this will be described in detail later, a plurality of concave portions 30 (see FIG. 6) is formed in the upper surface of the passage unit 4. The concave portions 30 are formed at approximately equal intervals. The pressure chamber group 9 is surrounded by the concave portions 30. From a plan view, each concave portion 30 is circular.

Furthermore, a plurality of surface electrodes 61 is formed at the upper surface of the actuator unit 21. Each surface electrode 61 corresponds to one concave portion 30. The surface electrodes 61 are formed outwards from the concave portions 30. That is, from a plan view, the surface electrodes 61 and the concave portions 30 are offset.

Figure 6:
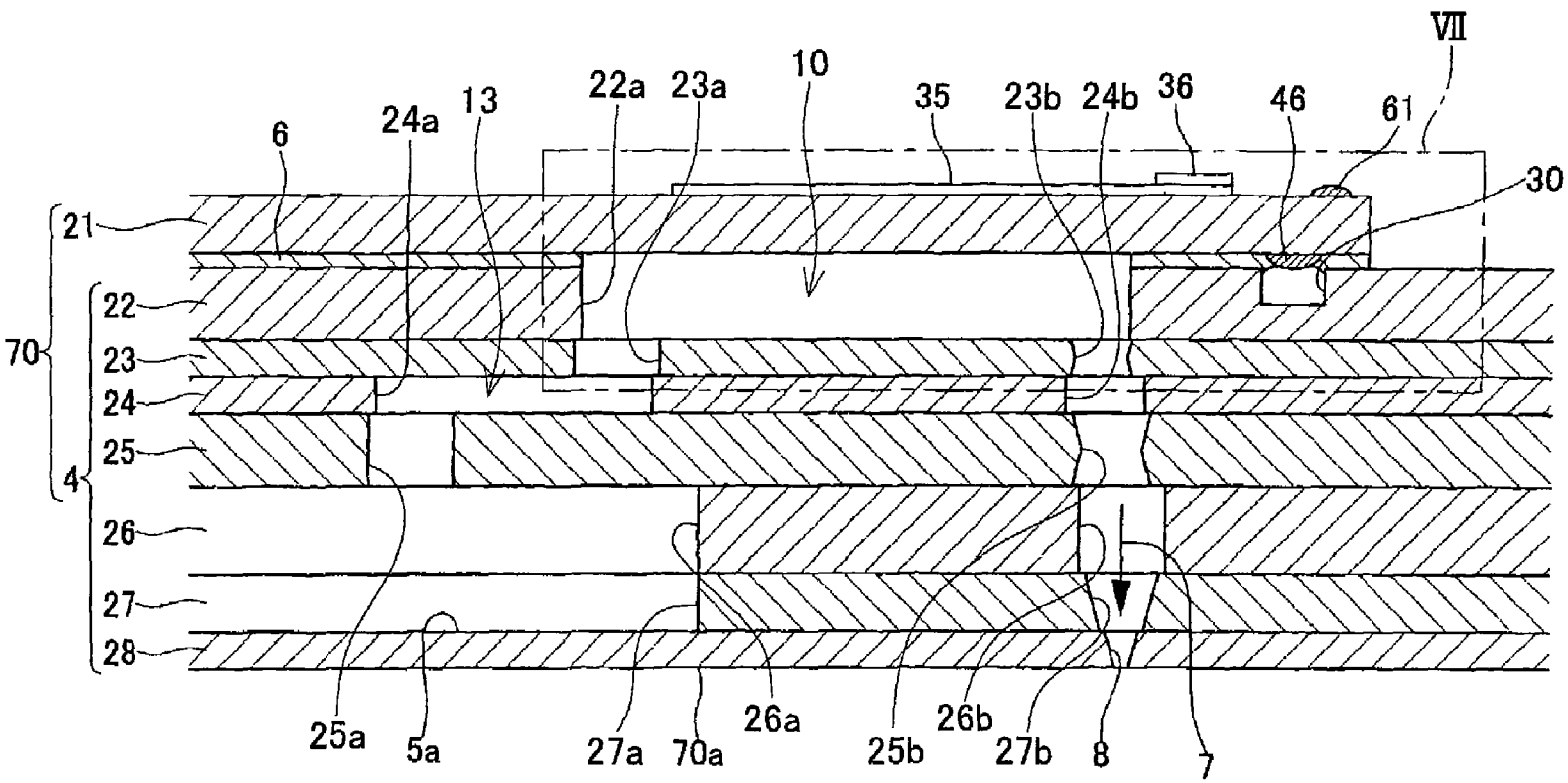
FIG. 6 shows a cross-sectional view along the line VI-VI of FIG. 4.

FIG. 6 shows a cross-sectional view along the line VI-VI of FIG. 4. The passage unit 4 has a cavity plate 22, a base plate 23, an aperture plate 24, a supply plate 25, two manifold plates 26 and 27, and a nozzle plate 28. The plates 22~28 are formed from metal (for example, from stainless steel). However, the nozzle plate 28 may be formed from resin.

The cavity plate 22 has a long hole 22*a*. The long hole 22*a* functions as the pressure chamber 10. Further, the concave portion 30 is formed in an upper surface of the cavity plate 22. The concave portion 30 opens upward (toward the actuator unit 21). In FIG. 6 only one long hole 22*a* and one concave portion 30 have been shown. However, a plurality of long holes 22*a* and a plurality of concave portions 30 are formed in the cavity plate 22.

The base plate 23 has holes 23*a* and holes 23*b*. Each hole 23*a* corresponds to different one pressure chamber 10. Each hole 23*b* corresponds to different one pressure chamber 10. Each hole 23*a* is formed at a position facing one edge of a corresponding pressure chamber 10. Each hole 23*b* is formed at a position facing the other edge of a corresponding pressure chamber 10.

The aperture plate 24 has long holes 24*a* and holes 24*b*. The long holes 24*a* function as the apertures 13. Each long hole 24*a* corresponds to different one hole 23*a* of the base plate 23. Each hole 24*b* corresponds to different one hole 23*b* of the base plate 23. One end of each long hole 24*a* is disposed at a position facing a corresponding hole 23*a* of the base plate 23. Each hole 24*b* is disposed at a position facing a corresponding hole 23*b* of the base plate 23.

The supply plate 25 has holes 25*a* and 25*b*. Each hole 25*a* corresponds to different one long hole 24*a* of the aperture plate 24. Each hole 25*b* corresponds to different one hole 24*b* of the aperture plate 24. Each hole 25*a* is disposed at a position facing the other end of a corresponding long hole 24*a* of the aperture plate 24. Each hole 25*b* is disposed at a position facing a corresponding hole 24*b* of the aperture plate 24.

The first manifold plate 26 has a long hole 26*a* and holes 26*b*. The long hole 26*a* functions as the sub manifold passage 5*a*. The holes 25*a* of the supply plate 25 communicate with the long hole 26*a*. Each hole 26*b* corresponds to different one hole 25*b* of the supply plate. Each hole 26*b* is disposed at a position facing a corresponding hole 25*b* of the supply plate 25.

The other manifold plate 27 also has a long hole 27*a* and holes 27*b*. The long hole 27*a* has the same shape as the long hole 26*a* of the manifold plate 26. The long hole 27*a* functions as the sub manifold passage 5*a*. Each hole 27*b* corresponds to different one hole 26*b* of the manifold plate 26. Each hole 27*b* is disposed at a position facing a corresponding hole 26*b* of the manifold plate 26.

The nozzle plate 28 has the nozzles 8. Each nozzle 8 corresponds to different one hole 27*b* of the manifold plate 27. Each nozzle 8 is disposed at a position facing a corresponding hole 27*b* of the manifold plate 27.

The sub manifold passages 5*a* communicate with the nozzles 8 via the apertures 13 and the pressure chambers 10. That is, the ink passages 7 that extend from the sub manifold passages 5*a* to the nozzles 8 via the apertures 13 and the pressure chambers 10 are formed in the passage unit 4. One ink passage 7 is formed for each of the pressure chambers 10.

One ink passage 7 is provided with two passages that have the pressure chamber 10 in the center thereof. The first passage extends from an upper end of the sub manifold passage 5*a* to one edge (at the left side in FIG. 6) of the pressure chamber 10 via the aperture 13. The other passage extends from the other edge (at the right side in FIG. 6) of the pressure chamber 10 to the nozzle 8.

The reference number 6 in FIG. 6 refers to the conductive adhesion layer. The conductive adhesion layer 6 is formed between a front surface (the upper surface in FIG. 6) of the cavity plate 22 of the passage unit 4 and a back surface (the lower surface in FIG. 6) of the actuator unit 21. The passage unit 4 and the actuator unit 21 are bonded together by means of the conductive adhesion layer 6.

Figure 7:
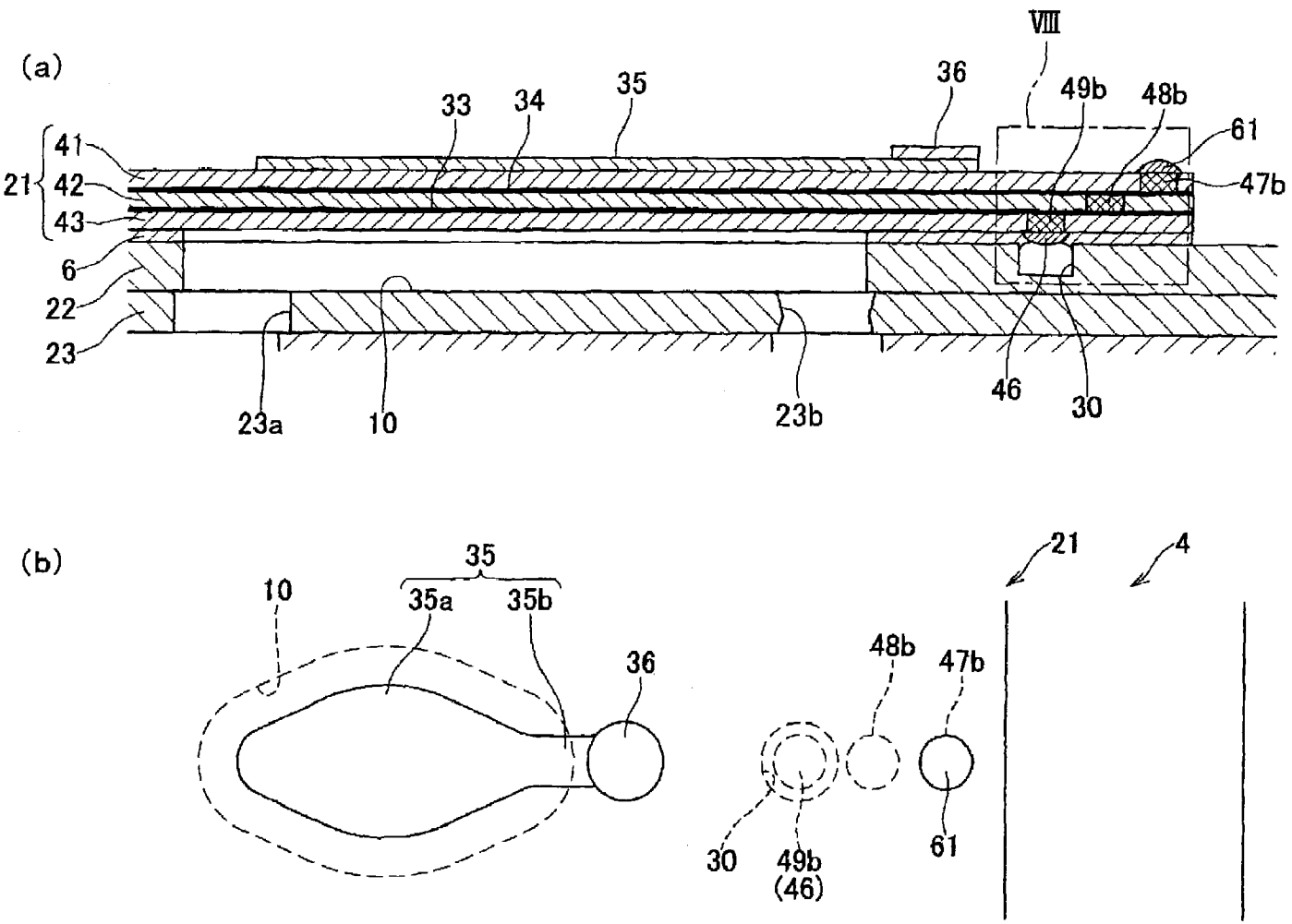
FIG. 7 (*a*) shows an expanded view of a region VII of FIG. 6.

Next, the configuration of the actuator unit 21 will be described. FIG. 7 (*a*) shows an expanded view of a region VII of FIG. 6. FIG. 7 (*b*) shows a plan view of a part of the region VII of FIG. 6.

The actuator unit 21 has three piezoelectric sheets 41, 42, and 43. The piezoelectric sheets 41, 42, and 43 are formed from lead zirconate titanate (PZT) ceramic material (an insulating material), and are ferroelectric. The thickness of each of the piezoelectric sheets 41, 42, and 43 is approximately 15 μm.

The uppermost piezoelectric sheet 41 functions as an active part that shows piezoelectric effects when an electric field is applied thereto. The remaining two piezoelectric sheets 42 and 43 do not function as active parts. The piezoelectric sheets 41, 42, and 43 are disposed so as to cover the pressure chamber group 9 (see FIG. 4 or FIG. 5).

In the present embodiment, the three piezoelectric sheets 41, 42, and 43 have a stacked configuration. Individual electrodes 35 (to be described) or the surface electrodes 61 can be disposed with a high density on an upper surface of the piezoelectric sheet 41 by using, for example, the screen printing technique. When the individual electrodes 35 can be disposed with a high density, the pressure chambers 10 can also be disposed with a high density in positions corresponding to the individual electrodes 35. High resolution printing can thus be realized.

The actuator unit 21 has a plurality of electrodes 33, 34, 35, and 61. The individual electrodes 35 and the surface electrodes 61 are disposed on the upper surface of the piezoelectric sheet 41. In FIG. 7 (*a*), only one individual electrode 35 has been shown. However, a plurality of individual electrodes 35 is actually disposed. Each individual electrode 35 is disposed at a position facing different one pressure chamber 10. Furthermore, as shown in FIG. 5, etc. a plurality of the surface electrodes 61 is disposed on the upper surface of the piezoelectric sheet 41.

As shown in FIG. 7 (*b*), each individual electrode 35 has a main area 35*a* and an auxiliary area 35*b*. The main area 35*a* is disposed at a position facing the pressure chamber 10. The main area 35*a* has a plan shape approximately similar to the pressure chamber 10 (approximately diamond shaped). The main area 35*a* is smaller than the pressure chamber 10.

The auxiliary area 35*b* is connected with an acute angle portion of the main area 35*a*. The auxiliary area 35*b* is disposed at a position that is not facing the pressure chamber 10. A round connecting part 36 is formed at an anterior edge of the auxiliary area 35*b*. The connecting part 36 is formed from, for example, metal that contains glass flit. The connecting part 36 is electrically connected with the auxiliary area 35*b*.

Although this is not shown, a plurality of connecting parts is formed in the FPC 50 (see FIG. 2). Each connecting part 36 of the individual electrodes 35 is electrically connected with the respective connecting part of the FPC 50. The connecting parts of the FPC 50 are electrically connected with the driver IC 80 (see FIG. 2). With this structure, the driver IC 80 can individually control the electric potential of each of the individual electrodes 35.

As shown in FIG. 7 (*a*), the electrode 34, which is a common electrode, is disposed between the uppermost piezoelectric sheet 41 and the piezoelectric sheet 42 formed below the piezoelectric sheet 41. The common electrode 34 has a thickness of approximately 2 μm. The common electrode 34 has approximately the same plan shape as the piezoelectric sheets 41, etc. A front surface (upper surface in FIG. 7 (*a*)) of the common electrode 34 makes contact with a back surface (lower surface in FIG. 7 (*a*)) of the piezoelectric sheet 41. A back surface of the common electrode 34 makes contact with a front surface of the piezoelectric sheet 42.

The electrode 33, which is a reinforcing electrode, is disposed between the piezoelectric sheet 42 and the lowermost piezoelectric sheet 43. The reinforcing electrode 33 also has a thickness of approximately 2 μm, and has approximately the same plan shape as the piezoelectric sheets 41, etc. A front surface of the reinforcing electrode 33 makes contact with a back surface of the piezoelectric sheet 42. A back surface of the reinforcing electrode 33 makes contact with a front surface of the piezoelectric sheet 43.

The electrodes 33, 34, 35, and 61 are made from a metal material such as, for example, Ag—Pd.

Figure 8:
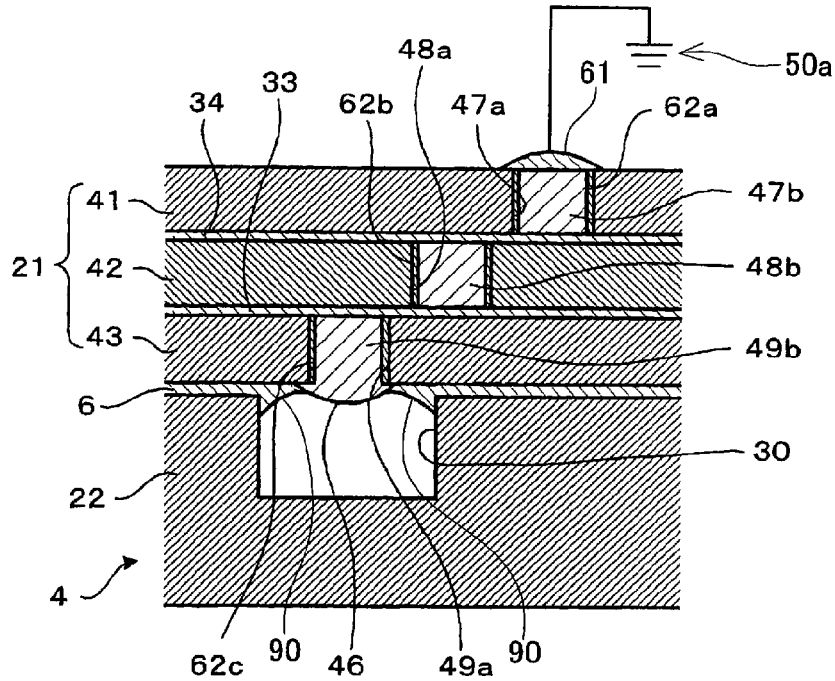
FIG. 8 shows an expanded view of a region VIII of FIG. 7 (*a*).

The configuration of the actuator unit 21 will be described in more detail with reference to FIG. 8. FIG. 8 shows an expanded view of a region VIII of FIG. 7.

The piezoelectric sheet 41 has a through hole 47*a*. The through hole 47*a* is disposed at a position facing the surface electrode 61. The diameter of the surface electrode 61 is greater than the opening of the through hole 47*a*. Although only one through hole 47*a* has been shown in FIG. 8, a plurality of through holes 47*a* is actually formed. The number of through holes 47*a* is the same as the number of surface electrodes 61 (i.e. the number of concave portions 30 of the passage unit 4 (see FIG. 5)).

The piezoelectric sheet 42 has through holes 48*a*. The number of through holes 48*a* is the same as the number of through holes 47*a*. The through holes 48*a* are formed in positions offset from the through holes 47*a*.

The piezoelectric sheet 43 has through holes 49*a*. The number of through holes 49*a* is the same as the number of through holes 47*a*. The through holes 49*a* are formed in positions offset from the through holes 47*a* and 48*a*. That is, the through holes 47*a*, 48*a*, and 49*a* are mutually offset when the ink jet head 1 is viewed from a plan view. Each through hole 49*a* is formed at a position facing different one concave portion 30. A center of an opening of the through hole 49*a* is in approximately the same position as a center of an opening of the concave portion 30.

A tubular conductive member 62*a* (a tubular member 62*a*) is disposed within the through hole 47*a*. An upper end of the tubular member 62*a* makes contact with the surface electrode 61. A lower end of the tubular member 62*a* makes contact with the front surface (upper surface in FIG. 8) of the common electrode 34. A column shaped conductive member 47*b* (a columnar member 47*b*) is disposed within the tubular member 62*a*. The columnar member 47*b* makes contact with an inner surface of the tubular member 62*a*. An upper end of the columnar member 47*b* makes contact with the surface electrode 61, and a lower end of the columnar member 47*b* makes contact with the front surface of the common electrode 34.

A tubular conductive member 62*b* (a tubular member 62*b*) is disposed within the through hole 48*a*. An upper end of the tubular member 62*b* makes contact with a back surface (lower surface in FIG. 8) of the common electrode 34. A lower end of the tubular member 62*b* makes contact with a front surface of the reinforcing electrode 33. A column shaped conductive member 48*b* (a columnar member 48*b*) is disposed within the tubular member 62*b*. The columnar member 48*b* makes contact with an inner surface of the tubular member 62*b*. An upper end of the columnar member 48*b* makes contact with the back surface of the common electrode 34, and a lower end of the columnar member 48*b* makes contact with the front surface of the reinforcing electrode 33.

A tubular conductive member 62*c* (a tubular member 62*c*) is disposed within the through hole 49*a*. An upper end of the tubular member 62*c* makes contact with a back surface of the reinforcing electrode 33. A lower end of the tubular member 62*c* makes contact with a columnar member 49*b* (to be described). The column shaped conductive member 49*b* (a columnar member 49*b*) is disposed within the tubular member 62*c*. The columnar member 49*b* makes contact with an inner surface of the tubular member 62*c*. An upper end of the columnar member 49*b* makes contact with the back surface of the reinforcing electrode 33. The columnar member 49*b* protrudes downwards beyond the through hole 49*a*. This protruding portion is termed a terminal 46. The terminal 46 of the columnar member 49*b* makes contact with the conductive adhesion layer 6.

The center of the terminal 46 of each columnar member 49*b* has a downwardly protruding shape. The terminal 46 is located at a position facing the concave portion 30 of the passage unit 4. Outer edge of the terminal 46 is located further outwards than outer edge of the through hole 49*a*. That is, from a plan view, the diameter of the terminal 46 is greater than the diameter of the through hole 49*a*. Further, the diameter of the terminal 46 is smaller than the diameter of the opening of the concave portion 30. A portion of the terminal 46 fits into the concave portion 30. As a result, the terminal 46 and the passage unit 4 do not interfere. When the actuator unit 21 and the passage unit 4 are to be bonded together, pressing force applied to the two can thus be prevented from accumulating at the terminal 46.

Tip of the terminal 46 is not covered by the conductive adhesion layer 6. A filet 90 of the conductive adhesion layer 6 is formed between the terminal 46 and an inner surface of the concave portion 30. The filet 90 of the conductive adhesion layer 6 is formed when the back surface of the actuator unit 21 (the back surface of the piezoelectric sheet 43) is bonded to the passage unit 4. Below, the manner in which the filet 90 is formed will be described.

Conductive adhesive is applied across approximately the entirety of a front surface of the passage unit 4 (the upper surface of the cavity plate 22). Then the back surface of the actuator unit 21 is pressed onto the front surface of the passage unit 4. The conductive adhesive spreads out between the passage unit 4 and the actuator unit 21. The conductive adhesive that is near the concave portion 30 spreads out such that it enters the concave portion 30. The conductive adhesive thus adheres to the terminal 46 and forms the filet 90 between the terminal 46 and the inner surface of the concave portion 30.

A first inner wiring which is configured by the tubular members 62*a*, 62*b*, and 62*c*, and a second inner wiring which is configured by the columnar members 47*b*, 48*b* and 49*b*, are aligned within the actuator unit 21. The common electrode 34 and the reinforcing electrode 33 are included in a portion of a conductive path of the first inner wiring. The common electrode 34 and the reinforcing electrode 33 are also included in a portion of a conductive path of the second inner wiring.

One end of a conductive path which is configured by the first inner wiring and the second inner wiring is connected with the surface electrode 61. The FPC 50 (see FIG. 2) has a ground potential connecting part 50*a*. The surface electrode 61 is soldered to the connecting part 50*a*. The other end of the conductive path (the terminal 46) makes contact with the conductive adhesion layer 6. The conductive adhesion layer 6 joins with the passage unit 4. As a result, the surface electrode 61, the common electrode 34, the reinforcing electrode 33, and the passage unit 4 are all maintained at ground potential.

Next, the method of driving the actuator unit 21 will be described with reference to FIG. 7 (*a*). The uppermost piezoelectric sheet 41 functions as an active layer, and the remaining piezoelectric sheets 42 and 43 do not function as active layers. That is, in the actuator unit 21 of the present embodiment, the piezoelectric sheet 41 that is far from the pressure chambers 10 is the active layer, and the two piezoelectric sheets 42 and 43 that are close to the pressure chambers 10 are non-active layers. This type of structure is termed a unimorph type.

A direction of polarization of the piezoelectric sheet 41 is its direction of thickness. When a predetermined positive or negative potential is set for the individual electrode 35, the part of the piezoelectric sheet 41 facing the individual electrode 35 contracts in a planar direction (a left-right direction in FIG. 7 (*a*)) due to piezoelectric effects. By contrast, the piezoelectric sheets 42 and 43 are not affected by the electric field, and consequently do not contract spontaneously. As a result, the force for making the piezoelectric sheet 41 contract in a planar direction is converted into a force for bending the piezoelectric sheets 42 and 43 in their direction of thickness. The piezoelectric sheets 41, 42, and 43 consequently deform so as to protrude downwards. This deformation is termed unimorph deformation.

When the piezoelectric sheets 41, 42, and 43 deform so as to protrude downwards, the volume of the pressure chamber 10 decreases. The pressure of the ink within the pressure chamber 10 is increased, and this ink is discharged from the nozzle 8. When the electric potential of the individual electrode 35 returns to the same electric potential as the common electrode 34, the piezoelectric sheets 41, 42, and 43 return to their original shape (the shape in FIG. 7 (*a*)). The volume of the pressure chamber 10 therefore increases, and ink is drawn into the pressure chamber 10 from the sub manifold passage 5*a*.

With the ink jet head 1 of the present embodiment, the common electrode 34, the reinforcing electrode 33, and the passage unit 4 are all maintained at ground potential. As a result, the phenomenon wherein components of the ink within the passage unit 4 enter the actuator unit 21 can be prevented effectively.

In the present embodiment, the conductive adhesion layer 6 is sandwiched between the passage unit 4 and the actuator unit 21. As a result, the conductive adhesion layer 6 adheres firmly to both the passage unit 4 and the actuator unit 21. The phenomenon wherein the conductive adhesion layer 6 becomes separated from the passage unit 4 or the actuator unit 21 can therefore be prevented effectively. The passage unit 4 and the common electrode 34 (or the reinforcing electrode 33) have a stable electrical connection.

Further, in the present embodiment, the entire path of the conductive path from the passage unit 4 to the surface electrode 61 is formed within the ink jet head 1. As a result, external force is not applied directly to the conductive path, and therefore interruption of the conductive path can be prevented effectively.

Since the conductive path is formed within the ink jet head 1, the connecting parts of each member are also formed within the ink jet head 1. That is, the following the connecting parts are not formed along a side surface of the actuator unit 21, but are formed within spaces that are isolated from the exterior: (1) the connecting part between the terminal 46 and the conductive adhesion layer 6, (2) the connecting part between the reinforcing electrode 33 and the columnar member 49*b* (or the tubular member 62*c*), (3) the connecting part between the reinforcing electrode 33 and the columnar member 48*b* (or the tubular member 62*b*), (4) the connecting part between the columnar member 48*b* (or the tubular member 62*b*) and the common electrode 34, (5) the connecting part between the common electrode 34 and the columnar member 47*b* (or the tubular member 62*a*), and (6) the connecting part between the columnar member 47*b* (or the tubular member 62*a*) and the surface electrode 61. Since external force cannot be applied directly to the connecting parts, interruption of the conductive path can be prevented effectively.

In the present embodiment, as shown in FIG. 5, a plurality of the surface electrodes 61 is distributed at a plurality of locations, and each surface electrode 61 is electrically connected with the common electrode 34. Since the plurality of surface electrodes 61 is electrically connected with the common electrode 34, the common electrode 34 can reliably be maintained at ground potential.

From a plan view of the ink jet head 1, the plurality of terminals 46 is disposed so as to surround the pressure chamber group 9. With this configuration, the terminals 46 are not disposed between the pressure chambers 10 and, as a result, the pressure chambers 10 can be disposed with a high density. Further, many terminals 46 are provided, and these terminals 46 are connected with the conductive adhesion layer 6. As a result, there is a reliable electrical connection between the common electrode 34 and the passage unit 4.

Each terminal 46 is located at a position facing the concave portion 30 formed in the upper surface of the passage unit 4. With this configuration, the terminal 46 and the passage unit 4 do not make contact. As a result, it is possible to prevent damage to the actuator unit 21 when the actuator unit 21 and the passage unit 4 are to be bonded together.

Further, each terminal 46 protrudes downwards beyond the through hole 49*a*. The diameter of the terminal 46 is greater than the diameter of the through hole 49*a*. The filet 90 of the conductive adhesion layer 6 is formed between the terminal 46 and the inner surface of the concave portion 30. Since this configuration is adopted, there is a greater area of contact between the terminal 46 and the conductive adhesion layer 6. There is therefore a reliable electrical connection between the common electrode 34 and the passage unit 4.

The through holes 47*a*, 48*a*, and 49*a* are mutually offset. As a result, the members housed in the through holes 47*a*, 48*a*, and 49*a* can be prevented from interfering with one another. For example, if the through holes 47*a*, 48*a*, and 49*a* were formed at the same position and force were applied to the surface electrode 61 when the FPC 50 is being joined, this force could be applied to the columnar member 49*b* via the columnar members 47*b* and 48*b*. In this case, the columnar member 49*b* might come out of the through hole 49*a*. When the through holes 47*a*, 48*a*, and 49*a* are offset, as in the present embodiment, this phenomenon can be prevented.

Variants of the above embodiment will now be given.

Figure 9:
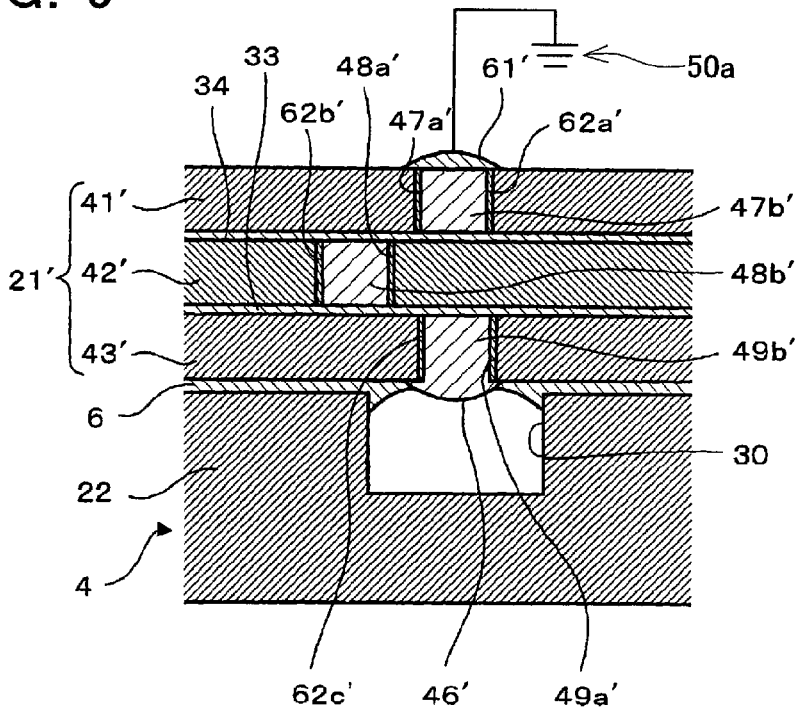
FIG. 9 shows a view for describing a variant embodiment.

(1) FIG. 9 shows a view for describing a variant. An actuator unit is represented by 21'. Piezoelectric sheets are represented by 41', 42', and 43'. Through holes are represented by 47*a*', 48*a*', and 49*a*'. Columnar members are represented by 47*b*', 48*b*', and 49*b*'. Tubular members are represented by 62*a*', 62*b*', and 62*c*'.

From a plan view, the through hole 48*a*' is offset from the through holes 47*a*' and 49*a*'. As a result, force applied to surface electrode 61' is not transmitted to the columnar member 49*b*'. Furthermore, the through holes 47*a*' and 49*a*' are formed at the same position. As a result, the planar area occupied by the through holes 47*a*', 48*a*', and 49*a*' (the width in the left-right direction) can be smaller than with the configuration of FIG. 8. Furthermore, when the operation of connecting the FPC 50 to the surface electrode 61' is executed simultaneously with the operation of connecting the passage unit 4 with the actuator unit 21, the force applied to the surface electrodes 61' is transmitted to the periphery of the concave members 30 directly below the surface electrode 61'. In this case, the filet can easily be formed at the conductive adhesion layer 6. This result can be obtained by overlapping (from a plan view) at least a portion of the surface electrode 61' with the concave member 30.

(2) In the above embodiment, the plurality of terminals 46 was disposed so as to surround the pressure chamber group 9. However, this configuration need not be adopted. Further, there may equally well be only one terminal 46. That is, there may equally well be only one conductive path formed from the passage unit 4 to the surface electrodes 61.

(3) The following method may be adopted as the method for driving the actuator unit 21. The individual electrode 35 and the common electrode 34 have a different electric potential while ink is not being discharged. In this condition, the piezoelectric sheets 41, 42, and 43 protrude downwards, and the volume of the pressure chamber 10 is smaller. When the ink is to be discharged, the individual electrode 35 is made to have the same electric potential as the common electrode 34. The state in which the piezoelectric sheets 41, 42, and 43 protrude downwards is thus released, and the volume of the pressure chamber 10 increases. The ink is drawn into the pressure chamber 10. Then, with a predetermined timing, the individual electrode 35 is made to have a different electric potential from the common electrode 34. The piezoelectric sheets 41, 42, and 43 protrude downwards, and the pressure of the ink within the pressure chamber 10 is increased. The ink is thus discharged from the nozzle 8.

(4) In the above embodiment, the columnar members 47*b*, 48*b*, and 49*b* (the tubular members 62*a*, 62*b*, and 62*c*) are fitted into the through holes 47*a*, 48*a*, and 49*a*. The entire path of the conductive path is thus formed within the ink jet head 1 from the passage unit 4 to the surface electrodes 61. However, the conductive path may equally well be formed along side surfaces of the piezoelectric sheets 41, 42, and 43.

(5) The terminals 46 may equally well have a configuration in which they do not protrude downwards beyond a lower surface of the piezoelectric sheet 43. In this case, the diameter of the through hole 49*a* may be greater than the diameter of the opening of the concave portion 30. Further, in this case, it is no longer necessary that the position of the concave portion 30 and the through hole 49*a* fit together accurately. From a plan view, the concave portion 30 and the through hole 49*a* may partially overlap.

(6) Further, the terminal 46 may equally well not have a configuration in which the center thereof protrudes downwards. For example, a central part of the terminal 46 may have a concave shape. Furthermore, the entirety of the outer edge of the terminal 46 is located further outwards than the through hole 49*a*. However, this configuration need not necessarily be adopted. For example, the terminal 46 may have a configuration in which only a portion of the outer edge is located further outwards than the through hole 49*a*. As another example, the terminal 46 may have a configuration in which the entirety of the outer edge of the terminal 46 is located inwards from the through hole 49*a*.

(7) In the above embodiment, the concave portion 30 is formed in the upper surface of the passage unit 4. However, the concave portion 30 do not necessarily need to be formed. In this case, it is preferred that the columnar member 49*b* does not protrude downwards beyond the through hole 49*a*.

(8) In the above embodiment, the tubular member (for example 62*a*) and the columnar member (for example 47*b*) are disposed within the through hole (for example 47*a*). However, the tubular member does not necessarily need to be provided, and only the columnar member may be provided.

What is claimed is:

1. An ink jet head, comprising:

a passage unit comprising a nozzle, a pressure chamber communicating with the nozzle, and a concave portion;

an actuator unit comprising a piezoelectric layer, a first electrode connected with a front surface of the piezoelectric layer, a second electrode connected with a back surface of the piezoelectric layer, a first insulating layer located between the second electrode and the passage unit, and a first conductive member, wherein the first insulating layer comprises a first through hole located at a position facing the concave portion, at least a part of the first conductive member is located in the first through hole, one end of the first conductive member is electrically connected with the second electrode, and a conductive path from the one end of the first conductive member to the second electrode is formed inside the actuator unit; and a conductive adhesion layer adhering to both a front surface of the passage unit and a back surface of the first insulating layer, wherein an other end of the first conductive member makes contact with the conductive adhesion layer.

2. The ink jet head as in claim 1, wherein the other end of the first conductive member protrudes from the first through hole toward the conductive adhesion layer.

3. The ink jet head as in claim 2, wherein the diameter of the concave portion is greater than the diameter of the protruding portion of the first conductive member.

4. The ink jet head as in claim 2, wherein the diameter of the protruding portion of the first conductive member is greater than the diameter of the first through hole.

5. The ink jet head as in claim 1, wherein the actuator unit comprises a plurality of first conductive members, the first insulating layer comprises a plurality of first through holes, each first conductive member is located in a different one of the first through holes, one end of each first conductive member is electrically connected with the second electrode, and the other end of each first conductive member makes contact with the conductive adhesion layer.

6. The ink jet head as in claim 5, wherein the passage unit comprises a plurality of nozzles and a plurality of pressure chambers, each pressure chamber communicates with a different one of the nozzles, and from the plan view of the ink jet head, the pressure chambers are surrounded by the first through holes.

7. The ink jet head as in claim 1, wherein the first conductive member comprises a tubular conductive member and a columnar conductive member located in the tubular conductive member.

8. The ink jet head as in claim 1, wherein the actuator unit further comprises a second insulating layer located between the second electrode and the first insulating layer, and a second conductive member, the second insulating layer comprises a second through hole, at least a part of the second conductive member is located in the second through hole, one end of the second conductive member is electrically connected with the second electrode, the other end of the second conductive member is electrically connected with the one end of the first conductive member, and the conductive path from the one end of the first conductive member to the second electrode includes the second conductive member.

9. The ink jet head as in claim 8, wherein the actuator unit further comprises a conductive layer located between the first insulating layer and the second insulating layer, the one end of the second conductive member makes contact with the second electrode, the other end of the second conductive member makes contact with the conductive layer, the one end of the first conductive member makes contact with the conductive layer, and the conductive path from the one end of the first conductive member to the second electrode further includes the conductive layer.

10. The ink jet head as in claim 8, wherein from the plan view of the ink jet head, the first through hole and the second through hole are offset.

11. The inkjet head as in claim 1, wherein the actuator unit further comprises a third conductive member and a surface conductive member connected with the front surface of the piezoelectric layer, the piezoelectric layer comprises a third through hole, at least a part of the third conductive member is located in the third through hole, one end of the third conductive member is electrically connected with the surface conductive member, and the other end of the third conductive member is electrically connected with the second electrode.

12. The inkjet head as in claim 11, wherein a conductive path from the one end of the third conductive member to the surface conductive member is formed inside the actuator unit, and a conductive path from the other end of the third conductive member to the second electrode is formed inside the actuator unit.

13. The ink jet head as in claim 12, wherein the surface conductive member is located at a position facing the third through hole, the one end of the third conductive member makes contact with the surface conductive member, and the other end of the third conductive member makes contact with the second electrode.

14. The ink jet head as in claim 11, wherein the surface conductive member is electrically connected with ground potential.

15. The ink jet head as in claim 11, wherein from the plan view of the ink jet head, the first through hole and the third through hole are offset.

* * * * *